United States Patent [19]

Burnham

[11] 4,058,262

[45] Nov. 15, 1977

[54] FLUID SPRAY FOR GENERATING RECTANGULAR COVERAGE

[75] Inventor: Richard C. Burnham, Greenfield, Mass.

[73] Assignee: Bete Fog Nozzle Inc., Greenfield, Mass.

[21] Appl. No.: 658,070

[22] Filed: Feb. 13, 1976

[51] Int. Cl.[2] ..... B05B 1/26

[52] U.S. Cl. ..... 239/545; 62/64; 239/598; 239/550

[58] Field of Search ..... 239/543, 544, 545, 598, 239/550; 62/64

[56] References Cited

U.S. PATENT DOCUMENTS

| | | | |
|---|---|---|---|
| 208,717 | 10/1878 | Crooks | 239/598 |
| 614,194 | 11/1898 | Wilgus | 239/598 X |
| 1,641,274 | 9/1927 | Hughes | 239/543 X |
| 1,896,202 | 2/1933 | Richardson | 239/543 |
| 2,228,031 | 1/1941 | Harsch | 239/598 |
| 2,760,817 | 8/1956 | Novak | 239/543 X |
| 2,813,751 | 11/1957 | Barrett | 239/543 X |
| 2,815,298 | 12/1957 | Heffley | 239/543 X |
| 3,885,745 | 5/1975 | Wagener et al. | 239/543 X |

FOREIGN PATENT DOCUMENTS

| | | | |
|---|---|---|---|
| 1,141,211 | 8/1957 | France | 239/545 |

*Primary Examiner*—Evon C. Blunk
*Assistant Examiner*—Michael Mar
*Attorney, Agent, or Firm*—Chapin, Neal and Dempsey

[57] ABSTRACT

Fluid spray for generating rectangular coverage area which includes a tubular conduit or header carrying a fluid under pressure and a pair of spaced nozzles. Each nozzle includes a bore which receives liquid from the header and conducts it toward a concavely curved end wall. Each nozzle has a circumferentially extending orifice adjacent the end wall which faces toward an identical orifice of the other nozzle so that the spray from one nozzle impinges upon the spray from the other nozzle.

6 Claims, 4 Drawing Figures

FLUID SPRAY FOR GENERATING RECTANGULAR COVERAGE

BACKGROUND

In a typical liquid heat exchanger or evaporation system, such as used in air conditioning and condenser units, it is customary to provide one or two main water headers located in superposed relation spanning the bank of tubes carrying the fluid to be cooled. A plurality of smaller tubes or branches sixteen or twenty in number extend laterally from the headers and each branch has one or more nozzles which emit fine conical sprays which impinge on the fluid carrying tubes. Fine sprays have been used because of the relatively large surface area of the droplets emitted which results in optimum evaporative cooling efficiency. Accordingly, it had been necessary to provide multiple arrays of such small, fine spray nozzles. The number of nozzles in a typical installation may be on the order of 120 which are arranged in a generally uniform spacing to obtain an overall rectangular spray pattern within the usually rectangular housing of such heat exchange units. A great deal of mist is generated by such arrays and much of this impinges on the walls of the unit or is carried upwardly by rising convection air currents requiring the use of complex mist baffles to avoid loss of cooling water. Another drawback of these fine spray nozzles is excessive orifice wear because of the high droplet velocity. It has now been found, that at low water pressures, a coarse spray composed of large, low velocity droplets does not appreciably lower evaporative efficiency where the spray pattern generated has a relatively deep or thick blanket. A distinctive nozzle pair arrangement is used whereby in a typical installation 16 or 18 nozzles will achieve approximately the same evaporative efficiency as heretofore obtained with 120 nozzles.

It is the principal object of this invention to provide an improved spray nozzle array which emits a generally rectangular and uniform spray pattern over a wide range of fluid pressures, resulting in the efficient use of large, low velocity liquid droplets emitted by substantially fewer nozzles arranged in cooperative pairs.

It is a further object of this invention to provide a nozzle arrangement of the above type in which the spray pattern, while covering a relatively large area, takes the form of a relatively thick blanket and in which there are substantial improvements in orifice wear and mist reduction.

The above and other objects and advantages will be more readily apparent from the following description and with reference to the accompanying drawing, in which.

Figure 1:
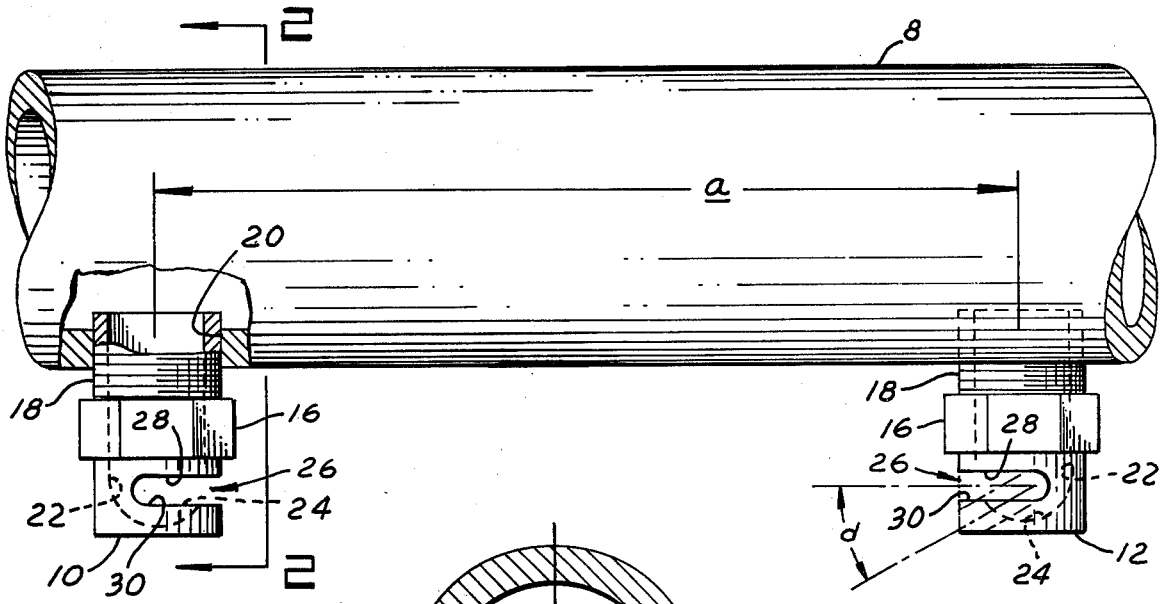
FIG. 1 is a side elevational view showing a spray embodying this invention.
Figure 4:
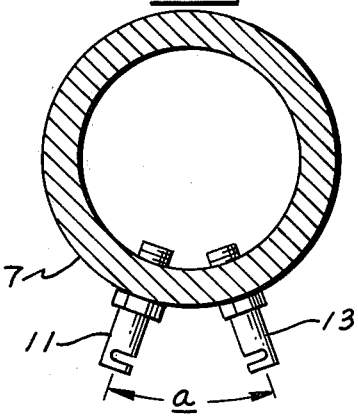
FIG. 4 is a view similar to FIG. 2 showing an alternate embodiment of the invention.

In FIG. 1 is shown a portion of a header or pipe 8 for carrying water under pressure. The header spans cooling coils 9 in the form of banks of tubes carrying fluid or liquid to be cooled by the spray generated by the nozzle array embodying this invention. The header may, therefore, constitute part of an air conditioning or evaporative cooling system wherein the tubes 9 would be carrying refrigerant, such as "Freon" which must be cooled after having absorbed heat from the chamber being cooled by the system. As shown, nozzles 10 and 12 of identical construction extend radially downward from the header and may be disposed about 6 inches - 12 inches above the top layer of coils 9. The nozzles form a cooperative pair being longitudinally spaced apart axially of the header at a distance *a* which results in a zone of interference or impingement of the spray emitted by the two nozzles whereby a generally overall rectangular spray coverage is generated. Alternatively, as shown in FIG. 4, a cooperative pair of nozzles 11 and 13 may extend radially from a header 7 in circumferentially spaced relation at a distance *a*. The construction and operation of these nozzles is essentially identical to the nozzles 10 and 12 hereinafter described in detail.

Each nozzle of a cooperative pair may be fitted by a nut 16 onto a pipe fitting 18 which extends through an opening 20 through the wall of the header. Each nozzle includes an axial bore 22, which communicates with the inner diameter of the pipe fitting 18 so that the water or other fluid medium under pressure within the header will flow into the bore 22 of each nozzle. A water pressure in the range of 0.5 to 20 psi is suitable for practice of this invention. At its outer end the bore 22 terminates in a concave semi-spherical surface 24, the concave surface of which faces upstream toward the header and preferably has its radius of curvature located along the axis of the bore 22. As a result of this construction, water under pressure flows smoothly and evenly from the bore 22 over the concave spherical end wall and out through the orifice 26 as a thick or deep spray.

Figure 2:
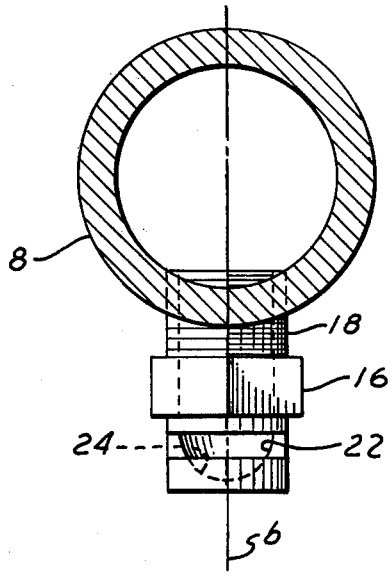
FIG. 2 is a view taken along line 2—2 of FIG. 1.
Figure 3:
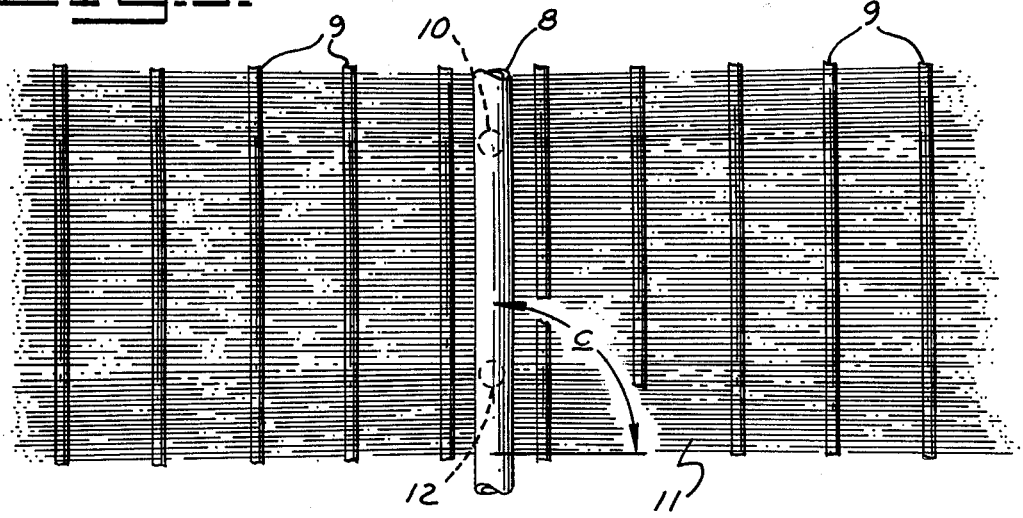
FIG. 3 is a plan view showing the typical coverage achieved by the spray embodying this invention.

Each nozzle has an orifice 26 which extends through the nozzle wall transversely of the axis of the bore 22 and communicates with the liquid flowing in the bore 22 and on the spherical end wall. The orifice 26 opening through the nozzle wall corresponds approximately to the juncture between the cylindrical surface of the bore 22 and the spherical end wall 24. The orifice is cut so that the level of flow from the orifice is substantially above the lower end of the spherical end wall. Desirable heavy flow patterns are achieved when the curved end wall 24 is continuous over approximately five-eighths to three-fourths of the area of a hemisphere. Orifice 26 is defined by a pair of axially spaced lips 28 and 30 which extend circumferentially in generally a parallel relationship over an arc of approximately 180°. Each orifice 26 has an axis of symmetry *b* (FIG. 2) located in a plane which in the illustrated embodiment contains the axis of the header 8. In the FIG. 2 embodiment, the plane of symmetry is parallel to the axis of the header 8 while in FIG. 4 it would be transverse to the axis of the header 7. From the axis of symmetry *b*, the lips 28 and 30 of the orifice extend circumferentially in both directions in generally parallel spaced relation and terminate in a circular edge or radius at the outer peripheral ends. The spacing of the lips or slot opening may vary from one-sixteenth inch to three-fourths inch and will provide a generally thick or deep spray blanket substantially uniformly distributed about the arc defined by the orifices. In cooperative pairs, the arcuate spray from one nozzle impacts with the spray from the other nozzle and there occurs substantial interference between the two sprays which is at a maximum parallel to the axis of symmetry *b* of the nozzle pair and diminishes gradually as the horizontal angle *c* (FIG. 3) increases outwardly from the axis *b*. In FIG. 3, the header 8 runs parallel to the axis *b* and minimum interference occurs in a direction perpendicular to the axis of the header 8. In the FIG. 4 embodiment, the axes of symmetry of the nozzles lie in a plane perpendicular to the axes of header 7 and maximum interference occurs along a line or band of interference between the nozzles and parallel to the header. The longer dimension of the spray pattern thus lies parallel to the header 7.

In accordance with the laws of probability, it will be apparent that most droplets from the nozzle 10 moving generally parallel to the header 8 in one direction will impact with most droplets of equal velocity traveling in the opposite direction from the nozzle 12. In this direction, therefore, maximum attenuation of the droplet velocity will occur. As the angle *c* increases, the droplets making up each spray will intercept at various oblique angles and the resultant spray droplets will be deflected laterally outward of the header and with a resultant reduced velocity. Minimal attenuation occurs as the angle *c* approaches 90° and as a result, the droplet velocity outward of the header is generally the same as would be the case if only a single nozzle were used. The overall resultant spray is rectangular, as shown in FIG. 3, and provides remarkably uniform water distribution over the areas of coverage. In one typical installation, the nozzles of each cooperative pair were spaced 8 inches apart along the header and a space of 13 inches provided between adjacent pairs of nozzles. At a water pressure of 0.32 psi, the pattern width obtained by this arrangement parallel to the header axis is about 21 inches and about 4 feet in length transversely of the header. By using five such opposing pairs of nozzles spaced about 13 inches apart, I have been able to generate a rectangular spray pattern covering an area approximately 36 square feet which laid down a flow rate of 1.43 gal/min/sq.ft. uniformly distributed over the area. Generally, the opposed pairs will produce a rectangular pattern having a length to width ratio of about 3:1.

The spray pattern developed by the circumferentially spaced nozzles 11 and 13 of FIG. 4 also develop a rectangular pattern with its longer dimension parallel to the axis of header 7 and smaller dimension transverse to the header. In one typical installation of the FIG. 4 type, with the nozzles spaced 18 inches above the media to be cooled, a rectangular spray pattern was achieved 18 inches in width and 48 inches in length measured parallel to the header 7.

While in the embodiment shown, the nozzle orifices are generally horizontal, it has been found that the spray pattern and flow rate can be varied by changing the nozzle spacing, slot opening, and the spray angle *d* from horizontal, as in FIG. 1, to a deflection of 30° to 45° (120° to 135° measured from the nozzle axis) which gives a smaller rectangular spray pattern but with greater flow rates. From the FIG. 4 embodiment, it will be realized that the spray angle *d* below the horizontal is a function of the header diameter and nozzle spacing *a*, as well as the angle at which the nozzle slot is cut. Of course, in this embodiment there will usually be a spray angle *d* below the horizontal unless the slot angle of the nozzle is cut above horizontal to compensate for the diameter of the header 7.

Having disclosed the invention herein, what is claimed is:

1. Spray apparatus for evaporational cooling of tubular media, the upper surfaces of which define a generally planar surface comprising a conduit carrying liquid under pressure and disposed above and generally parallel to said surface, at least one pair of nozzles depending in axially spaced relation from said conduit, each nozzle having an internal spherical end wall surface and an orifice opening through said spherical end wall surface and extending over an obtuse angle, said orifice being defined by upper and lower edges spaced apart from three-sixteenths inch to three-fourths inch, said orifice intersecting said spherical surface to provide a spherical surface below said orifice of about five-eighths to three-fourth the surface area of a hemisphere of the same radius as said spherical surface, each nozzle generating an arcuate spray of liquid droplets in generally parallel, superposed spaced relation to said planar surface of said tubular media, said nozzles being disposed in axially spaced relation on said conduit with the orifice of one nozzle opening directly toward the orifice of the other nozzle with the geometric center of each spray in general alignment with the axis of said conduit, the spacing between said pair of nozzles being such that the droplet velocity of the spray of each nozzle generated by a water pressure of 0.5 to 10 psi is attenuated by impact with the spray of the other nozzle, said attenuation being a maximum in a direction parallel to said axis and decreasing to a minimum as the spray angle from each nozzle increases toward a direction transverse to said axis whereby a generally rectangular spray pattern is deposited on said tubular media with its major dimension transverse to said conduit.

2. Spray apparatus for evaporational cooling as set forth in claim 1 in which each of said pairs of nozzles has an axial bore communicating with the interior of said conduit means and a semi-spherical outer end wall having its concave surface facing said bore.

3. Spray apparatus for evaporational cooling as set forth in claim 1 in which each orifice of said pair of nozzles is arcuate and in which the spray from each nozzle generally parallel to said tubular media is generated within an angle not more than 15° below a line parallel to said conduit.

4. Spray apparatus for evaporational cooling as set forth in claim 1 in which said obtuse angle is approximately a straight angle.

5. Spray apparatus for evaporational cooling as set forth in claim 1 in which a plurality of a pair of nozzles are provided, each pair being disposed in axially spaced relation along said conduit means providing an overall rectangular area of coverage which is a multiple of the rectangular area formed by each pair of said nozzles, the spacing between said lips being a slot from one-sixteenth inch to three-fourth inch, the liquid pressure in the header being in the range of 0.5 psi to 20 psi and the spacing between said nozzles being in the range of 2 inches to 14 inches.

6. Spray apparatus for evaporational cooling as set forth in claim 1 in which said nozzles each extend radially from said conduit means in circumferentially spaced relation.

* * * * *